US008139967B2

(12) United States Patent
Nishikawa

(10) Patent No.: US 8,139,967 B2
(45) Date of Patent: Mar. 20, 2012

(54) IMAGE FORMING APPARATUS HAVING AN IMAGE CARRYING AREA SWITCHING PART WHICH SWITCHES IMAGE CARRYING AREAS ON AN INTERMEDIATE TRANSFER PART

(75) Inventor: Shingo Nishikawa, Hyogo (JP)

(73) Assignee: Kyocera Mita Corporation (JP)

( * ) Notice: Subject to any disclaimer, the term of this patent is extended or adjusted under 35 U.S.C. 154(b) by 547 days.

(21) Appl. No.: 12/272,447

(22) Filed: Nov. 17, 2008

(65) Prior Publication Data

US 2009/0136250 A1 May 28, 2009

(30) Foreign Application Priority Data

Nov. 28, 2007 (JP) ..... 2007-307070

(51) Int. Cl.
*G03G 15/16* (2006.01)

(52) U.S. Cl. ..... 399/66; 399/308

(58) Field of Classification Search ..... 399/66, 399/308

See application file for complete search history.

(56) References Cited

U.S. PATENT DOCUMENTS

| | | | | |
|---|---|---|---|---|
| 6,574,442 | B2 * | 6/2003 | Kibune | 399/49 |
| 7,035,578 | B1 * | 4/2006 | Young | 399/322 |
| 2006/0056864 | A1 * | 3/2006 | Zaima | 399/27 |
| 2008/0038015 | A1 * | 2/2008 | Lai et al. | 399/160 |

FOREIGN PATENT DOCUMENTS

JP 2002-278203 A 9/2002

OTHER PUBLICATIONS

Machine translation of Katsuno et al i.e. JP-11-002934.*

* cited by examiner

*Primary Examiner* — David Gray
*Assistant Examiner* — G. M. Hyder
(74) *Attorney, Agent, or Firm* — Ostrolenk Faber LLP

(57) ABSTRACT

An image forming apparatus of the present invention includes an image carrier, an intermediate transfer part, a primary transfer part, a secondary transfer part, and a transfer area change part. The image carrier is configured to carry a visible image formed with developer. The primary transfer part is configured to transfer the visible image from the image carrier to a transfer area on the intermediate transfer part. The secondary transfer part is configured to transfer the visible image from the intermediate transfer part to a recording medium. The transfer area change part is configured to change the transfer area.

8 Claims, 6 Drawing Sheets

IMAGE FORMING APPARATUS HAVING AN IMAGE CARRYING AREA SWITCHING PART WHICH SWITCHES IMAGE CARRYING AREAS ON AN INTERMEDIATE TRANSFER PART

CROSS-REFERENCE TO RELATED APPLICATIONS

This application claims priority under 35 U.S.C. §119 to Japanese Patent Application No. 2007-307070 filed on Nov. 28, 2007. The entire disclosure of Japanese Patent Application No. 2007-307070 is hereby incorporated herein by reference.

BACKGROUND OF THE INVENTION

1. Field of the Invention

The present invention relates to an image forming apparatus such as a printer, a copier, and a multifunction peripheral (MFP).

2. Related Art

Recently, image forming apparatuses (e.g., a printer, a copier, and a MFP) have been used as indispensable office machines in a company. At the same time, the image forming apparatuses have been widely used as household machines.

Some image forming apparatuses adopt a secondary transfer method. In the secondary transfer method, a visible image is formed with developer, and the visible image is transferred onto an intermediate transfer part. Then, the visible image on the intermediate transfer part is further transferred onto a recording medium (e.g., a sheet of paper).

It is required for the image forming apparatus adopting the secondary transfer method to determine accurately a position of the visible image on the intermediate transfer part for the purpose of accurately transferring the visible image onto a sheet of paper. Also, it is further required for a color-image forming apparatus adopting a method of forming a full-color image to adjust accurately a position of the visible image by overlapping various color visible images on the image transfer part.

In response to the above-mentioned demand, Japanese Patent Application Publication No. JP-A-2002-278203 discloses an apparatus for positioning a toner image based on a mark provided on an intermediate transfer belt (i.e., intermediate transfer part).

According to the Publication, when developer remains on the intermediate belt without being transferred onto a sheet of paper, a cleaning part is configured to remove it. However, it is impossible to remove completely the developer remaining on the intermediate belt. Therefore, developer will be gradually accumulated on the intermediate transfer belt as "grime." A great deal of grime accumulated on the intermediate transfer belt negatively impacts image quality. In other words, accurate and beautiful printing will not be performed. In this case, it is judged that the intermediate transfer belt has come to the end of its lifespan and accordingly needs to be replaced.

Accordingly, aspects of the present invention have been created to solve the above-mentioned problems occurring in the conventional practice and to provide an image forming apparatus for prolonging lifespan of an intermediate transfer part by dispersing grime on the intermediate transfer part.

SUMMARY OF THE INVENTION

An image forming apparatus of the present invention includes an image carrier, an intermediate transfer part, a primary transfer part, a secondary transfer part, and a transfer area change part. The image carrier is configured to carry a visible image formed with developer. The primary transfer part is configured to transfer the visible image from the image carrier to a transfer area on the intermediate transfer part. The secondary transfer part is configured to transfer the visible image from the intermediate transfer part to a recording medium. The transfer area change section is configured to change the transfer area.

BRIEF DESCRIPTION OF THE DRAWINGS

Referring now to the attached drawings which from a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment 1-1, Summary of Image Forming Apparatus 100

An image forming apparatus 100 according to a preferred embodiment of the present invention will be hereinafter specifically explained with reference to the attached figures. Note that the technical scope of the present invention is not limited by the following embodiment.

Figure 1:
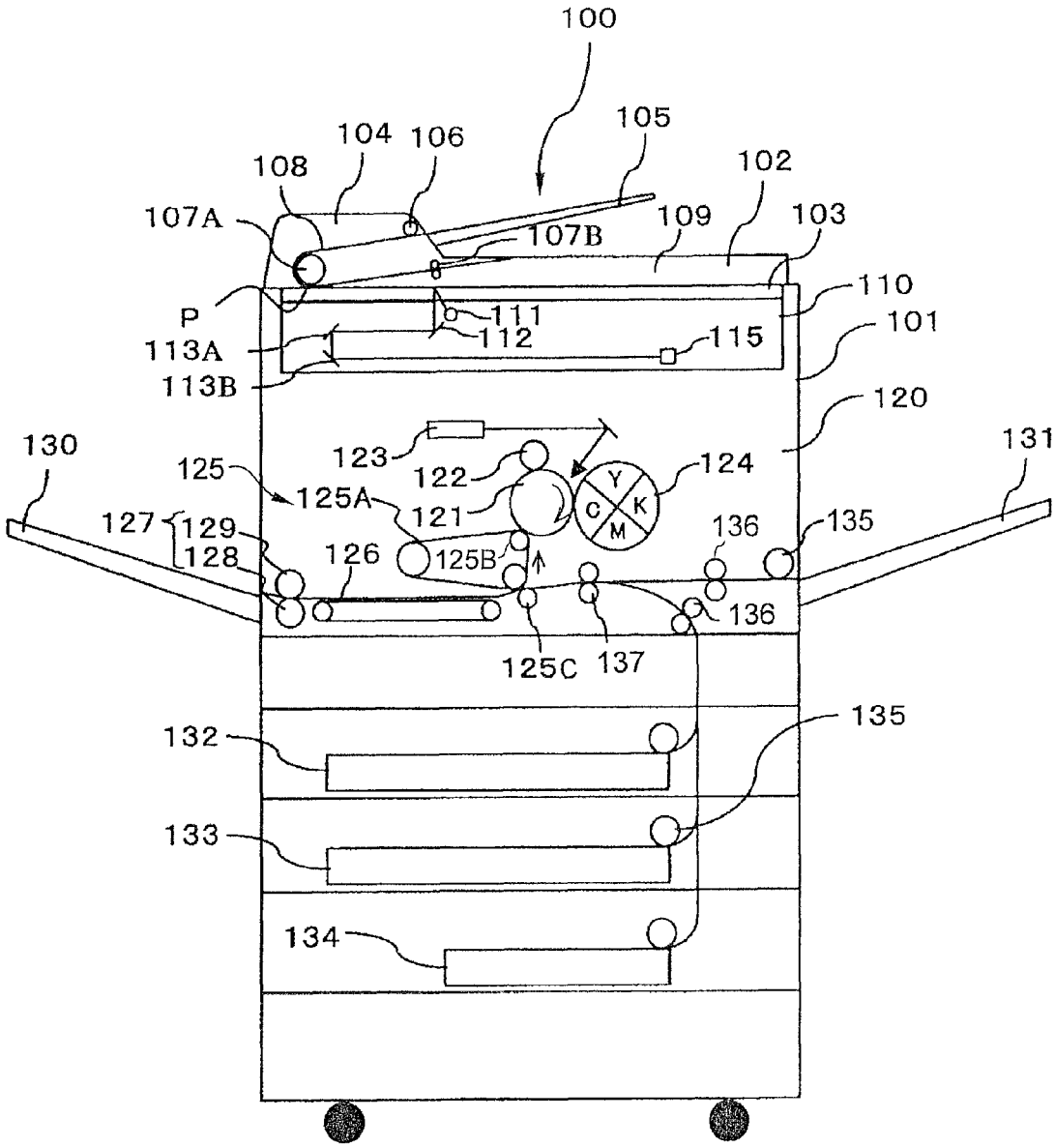
FIG. 1 is a view of a diagram for illustrating the entire configuration of an image forming apparatus in accordance with a preferred embodiment of the present invention.

FIG. 1 illustrates a configuration of the image forming apparatus 100 relating to scan and print functions.

As illustrated in FIG. 1, the image forming apparatus 100 includes a main body 101 and a platen cover 102.

The upper surface of the main body 101 is provided with a platen 103. The platen cover 102 is attached to the platen 103. The platen cover 102 is allowed to be positioned in an opened state to expose the platen 103 and a closed state to cover the platen 103. The main body 101 further includes a scan section 110, a print section 120, a discharge tray 130, paper feeding trays (e.g., a manual feeding tray 131 and paper feeding cassettes 132 to 134), a paper transporting sections and the like.

The platen cover 102 includes an automatic manuscript transporting unit 104, a paper setting plate 105, a paper discharge plate 109, and the like.

When a user makes a photocopy of a manuscript by operating the image forming apparatus 100, the user puts the manuscript on the platen 103 or the paper setting 105 illustrated in FIG. 1 and gives the image forming apparatus 100 an instruction to print by operating an operation panel provided in the vicinity of the paper setting plate 105. When the instruction is given to the image forming apparatus 100, the scan section 110 scans an image of the manuscript put on the platen 103 or an image of the manuscript to be transported by the automatic manuscript transporting unit 104. Then, the print section 120 prints the image onto a sheet of paper stored in any of the paper feeding trays (i.e., the manual feeding tray 131 and the paper feeding cassettes 132 to 134). Elements forming the sections will be hereinafter explained in detail.

As illustrated in FIG. 1, the automatic manuscript transporting unit 104 includes a manuscript transporting path 108, a pickup roller 106, transporting rollers 107A and 107B, and the like. The manuscript transporting path 108 is a path to transport a manuscript. The manuscript transporting path 108 is formed in the interior of the platen cover 102. The manuscript transporting path 108 starts from the paper setting plate 105, and reaches the paper discharge plate 109 via a scan position P. Note that the scan section 110 scans an image of the manuscript in the scan position P. The pickup roller 106 and the transporting rollers 107A and 107B are arranged in the interior of the platen cover 102.

In the automatic manuscript transporting unit 104, the pickup roller 106 takes a sheet of paper (or one of plural sheets of paper) put on the paper setting plate 105 and moves it to the manuscript transporting path 108. Then, the transporting rollers 107A and 107B and the like discharge the manuscript onto the paper discharge plate 109 via the scan position P.

Figure 2:
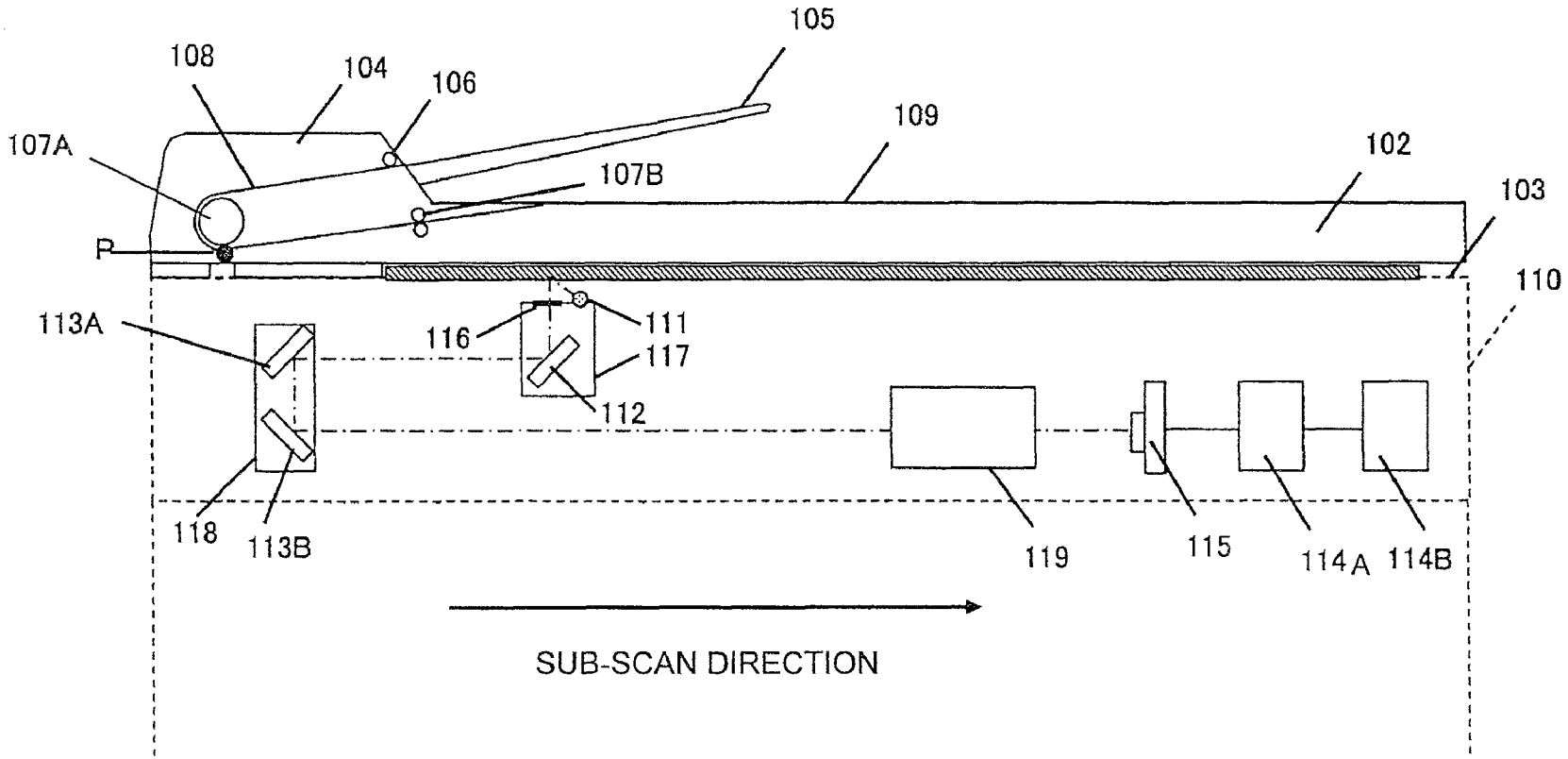
FIG. 2 is a view of a diagram illustrating elements forming a scan section of the image forming apparatus.

As illustrated in FIG. 1, the scan section 110 is disposed below the platen 103. FIG. 2 illustrates the detail of the scan section 110.

As illustrated in FIG. 2, the scan section 110 includes an image data generator 114A, a first storage 114B, an image sensor 115, a first carriage 117, a second carriage 118, a group of lenses 119, and the like.

The first carriage 117 is elongated in the main scanning direction, i.e. the direction perpendicular to the surface of sheet entitled FIG. 2. The first carriage 117 includes a light source 111, a slit 116, and a mirror 112. The light source 111 is disposed to irradiate the platen 103. The slit 116 is formed to pass selectively light from the platen 103 therethrough. The mirror 112 is disposed to reflect the light from the platen 103 and guiding the reflected light to the second carriage 118.

The second carriage 118 includes mirrors 113A and 113B. The mirrors 113A and 113B are disposed to reflect further the reflected light from the first carriage 117.

The group of lenses 119 is disposed to correct optically the light guided to the mirrors 113A and 113B.

The image sensor 115 is disposed to receive the light corrected by the group of lenses 119. The image sensor 115 is configured to transform the received light into an electric signal.

The image data generator 114A is configured to create image data by converting the analog electric signal from the image sensor 115 into a digital signal and by suitably performing a variety of processing (e.g., correction).

The first storage 114B is configured to store the image data created by the image data generator 114A.

When scanning is performed for the manuscript put on the automatic manuscript transporting unit 104, a moving mechanism (not illustrated in the figure) moves the light source 111 to a position to irradiate the scan position P, and the light source 111 emits light in the position. The light from the light source 111 penetrates the platen 103, and is reflected by the manuscript passing through the scan position P. Then, the reflected light is guided to the image sensor 115 through the slit 116, the mirrors 112, 113A, and 113B, and the group of lenses 119. The image sensor 115 transforms the received light into an electric signal and transmits it to the image data generator 114A. Here, the light received by the image sensor 115 is inputted into the image data generator 114A as analog red, green, and blue (RGB) signals. Then, the inputted analog signal is converted into a digital signal by a series of analog-digital conversion. Furthermore, the image data generator 114A uses the sequentially converted digital signal as unit data, and creates image data composed of a plurality of unit data by correcting and modifying the unit data as needed. Then, the image data generator 114A stores the image data in the first storage 114B.

The scan section 110 is configured to scan the manuscript put on the platen 103 as well as the manuscript to be transported by the automatic manuscript transporting unit 104. When the scan section 110 scans the manuscript put on the platen 103, the first carriage 117 moves the light source 111 in the sub-scan direction. On the other hand, the second carriage 118 moves toward the image sensor 115 at half the speed of the first carriage 117 to keep constant the length of light from the light source 111 to the image sensor 115. Then, the image sensor 115 transforms the light reflected by the manuscript put on the platen 103 into an electric signal. The image data generator 114A generates image data, and stores them in the first storage 114B.

As illustrated in FIG. 1, the print section 120 is arranged below the scan section 110 in the main body 101. The print section 120 is configured to print the image data onto a sheet of paper. The print section 120 is configured to print a variety of image data. For example, the image data include image data created by the image data generator 114A and image data transmitted through a network interface from a terminal (e.g., personal computer) connected to the image forming apparatus 100 through a network (e.g., LAN).

The print section 120 adopts the electro-photographic method. As illustrated in FIG. 1, the print section 120 includes a photosensitive drum 121 (which is an example of an image carrier), an electrostatic charger 122, a laser light source 123, a developing device 124, and transfer part 125. In this embodiment, the laser light source 123 and the developing device 124 function as a drawing part. The photosensitive drum 121 is configured to rotate. The charger 122, the laser light source 123, the developing device 124, and the transfer part 125 are disposed along the rotational direction of the photosensitive drum 121. Furthermore, the print section 120 includes a fixing part 127.

The electrostatic charger 122 is configured to uniformly electrostatic-charge the photosensitive drum 121. The laser light source 123 irradiates the charged photosensitive drum 121, and thus forms an electrostatic latent image on the photosensitive drum 121. The developing device 124 forms a visible image (i.e., toner image) by attaching toner to the electrostatic latent image. The transfer part 125 is configured to transfer the toner image onto a sheet of paper.

The developing device 124 is a rotary developing device. The developing device 124 is configured to rotate around a rotary shaft extending in the vertical direction orthogonal to the surface of the sheet illustrating the diagram of FIG. 1. The developing device 124 includes four developing units 124Y, 124M, 124C, and 124K. The four developing units are arranged around the rotary shaft. The developing units 124Y, 124M, 124C, and 124K store yellow (Y) toner, magenta (M) toner, cyan (C) toner, and black (K) toner, respectively.

The transfer part 125 includes an intermediate transfer belt 125A (which is an example of an intermediate transfer part), a primary transfer roller 125B (which is an example of a primary transfer part), and a secondary transfer roller 125C (which is an example of a secondary transfer part).

The intermediate transfer belt 125A is a looped belt stretched around rollers (e.g., the primary transfer roller 125B). The intermediate transfer belt 125A is configured to circulate around the rollers. A moving direction of the intermediate transfer belt 125A is the same as that of the photosensitive drum 121. Velocity of the intermediate transfer belt 125 (i.e., travel distance per unit time) is the same as that of the photosensitive drum 121. Here, "the same direction" does not refer to counter-trail direction but to trail direction. In other words, the photosensitive drum 121 is configured to rotate in a clockwise direction while the intermediate transfer belt 125A is configured to circulate in a counter-clockwise direction as illustrated in FIG. 1. With the above-mentioned configuration of the circulation direction and velocity of the intermediate transfer belt 125A, large frictional force is not easily generated between the intermediate transfer belt 125 and the photosensitive drum 121. As a result, a stable toner image will be formed.

The primary transfer roller 125B is disposed inside the loop of the intermediate transfer belt 125A. Specifically, the primary transfer roller 125B is opposed to the photosensitive drum 121. A secondary transfer roller 125C is disposed outside the intermediate transfer belt 125A. Specifically, the secondary transfer roller 125C is disposed downward of the primary transfer roller 125B in the rotational direction of the intermediate transfer belt 125A.

The toner image on the photosensitive drum 121 is transferred onto the intermediate transfer belt 125A by the primary transfer roller 125B. Then the toner image on the intermediate transfer belt 125A is transferred onto a sheet of paper by the secondary transfer roller 125C.

In printing of a color image, the electrostatic latent image on the photosensitive drum 121 is developed by the developing units 124Y, 124M, 124C, and 124K. Thus, the developing device 124 forms four different-color toner images. Then, the primary transfer roller 125B of the transfer part 125 repeatedly transfers the toner image on the photosensitive drum 121 onto the intermediate transfer belt 125A. Accordingly, the four toner images are overlapped on the intermediate transfer belt 125A. In other words, a full-color image is formed on the intermediate transfer belt 125A.

The fixing part 127 includes a heat roller 128 and a press roller 129. The heat roller 128 includes a built-in heater. The press roller 129 is configured to be pressed against the heat roller 128 at a predetermined pressure. The heat roller 128 and the press roller 129 respectively apply heat and pressure to a sheet of paper passing between them. Thus, the toner image is fixed onto the sheet of paper.

The discharge tray 130 is configured to receive a sheet of printed paper.

The paper feeding trays (e.g., the manual feeding tray 131 and the paper feeding cassette 132 to 134) stack/accommodate a printing medium (i.e., a bundle of paper) on which the toner image is printed.

The paper transporting section includes a pickup roller 135, a transport roller 136, a resist roller 137, a discharge roller (not illustrated in the figure), and the like. The paper transporting section transports a sheet of paper from the paper feeding trays to the transfer part 125 and the fixing part 127, and finally discharges it to the discharge tray 130.

The pickup roller 135 takes a sheet of paper out of the bundle of paper stacked/accommodated in any of the paper feeding trays. The transport roller 136 transports the taken-out paper toward the resist roller 137. The resist roller 137 sends the sheet of paper between the intermediate transfer belt 125A and the secondary transfer roller 125C at the timing when a position of the toner image on the intermediate transfer belt 125A is matched with a position of a sheet of paper. After the toner image is fixed onto the sheet of paper, the sheet of paper is discharged to the discharge tray 130 by the discharge roller (not illustrated in the figure).

1-2. Hardware Configuration of Image Forming Apparatus 100

A hardware configuration of the image forming apparatus 100 will be hereinafter specifically explained with reference to FIG. 3.

Figure 3:
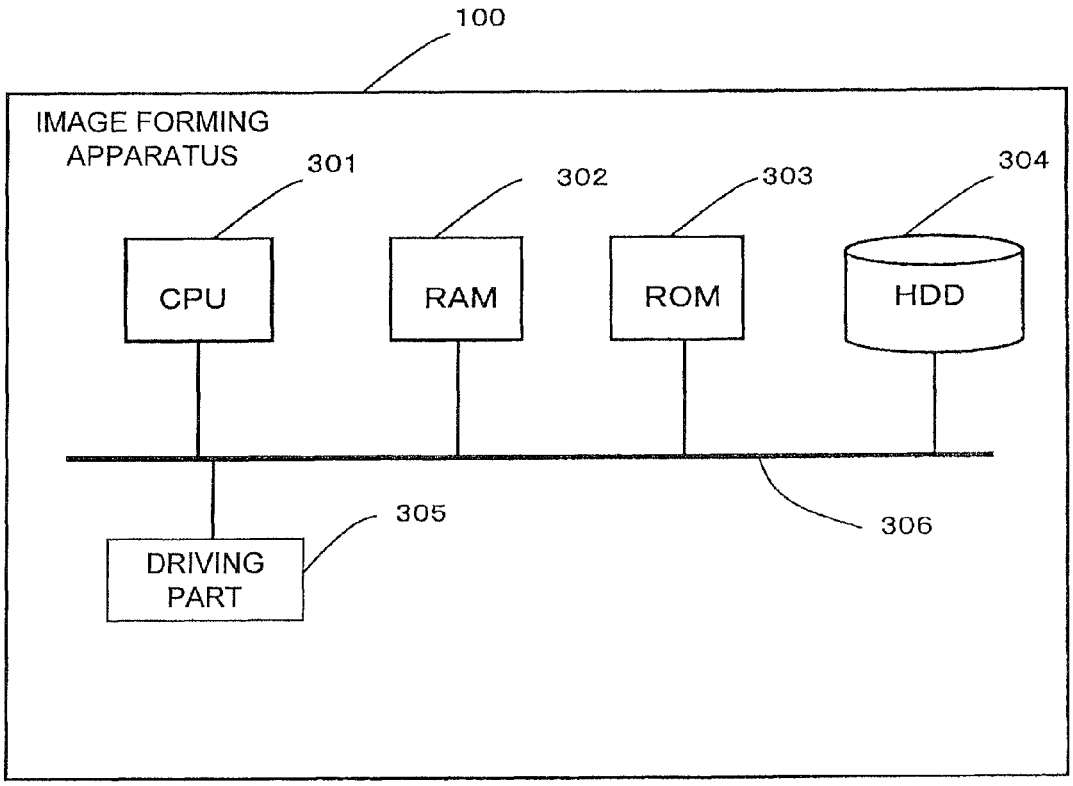
FIG. 3 is a view of a block diagram illustrating the hardware configuration of the image forming apparatus.

FIG. 3 is a view of a block diagram illustrating a hardware configuration of the image forming apparatus 100.

As illustrated in FIG. 3, the image forming apparatus 100 includes a central processing unit (CPU) 301, a random access memory (RAM) 302, a read only memory (ROM) 303, a hard disk drive (HDD) 304, and the like. Also, elements illustrated in FIGS. 1 and 2, motors to operate the elements, and the like are illustrated as a driving part 305 in FIG. 3. For example, the driving part 305 includes a motor to rotate the photosensitive drum 121, a motor to circulate the intermediate transfer belt 125A, a voltage application part to apply transfer voltage, and the like.

As illustrated in FIG. 3, elements in the image forming apparatus 100 are connected through an internal bus 306.

The CPU 301 reads out programs stored in the ROM 303 and the HDD 304, and controls an operation of the driving part 305. Accordingly, a variety of operations (e.g., a printing operation and a scanning operation) are executed. The RAM 302 is configured to function as a work area and to store temporarily data. Also, the HDD 304 stores a variety of data.

1-3. Selection and Switching of Transfer Area

Figure 4:
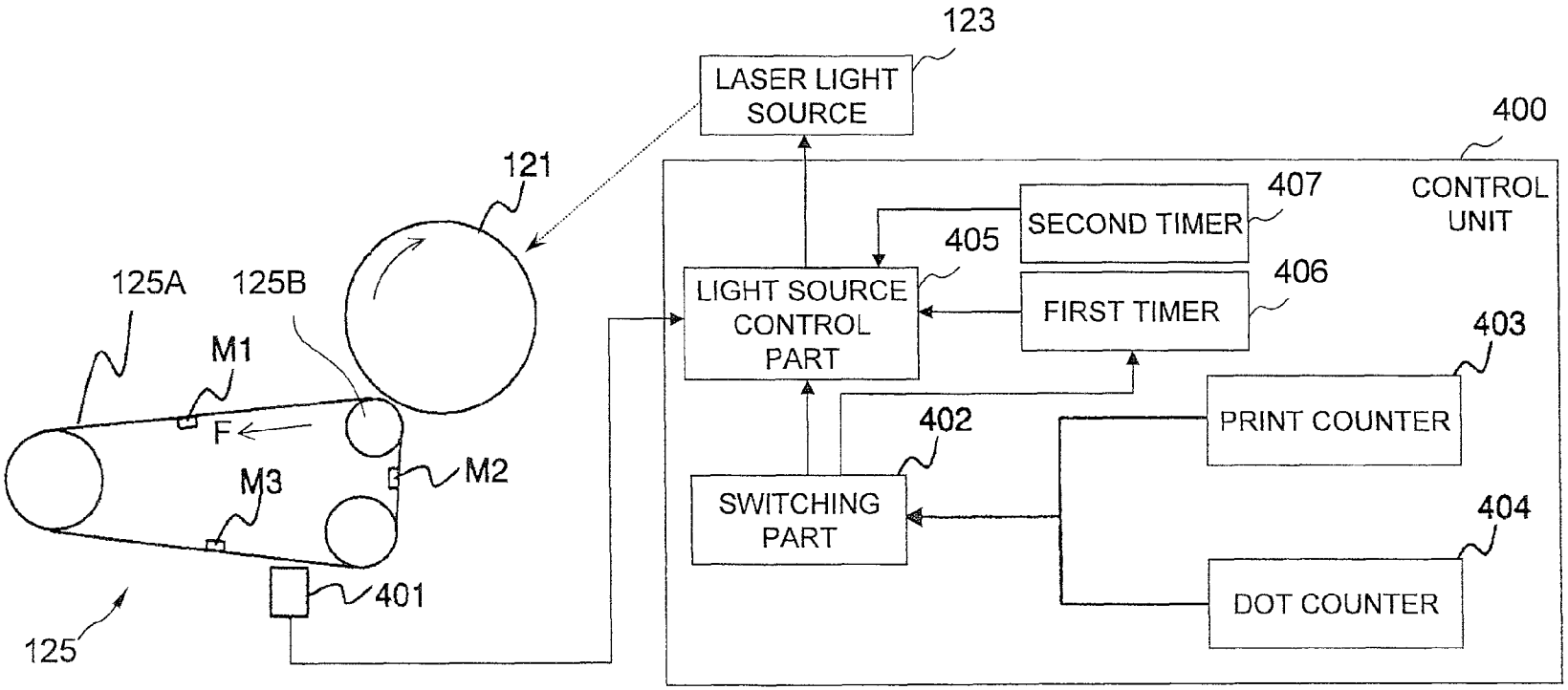
FIG. 4 is a view of a diagram illustrating a transfer section and its peripheral elements in the image forming apparatus.
Figure 5A:
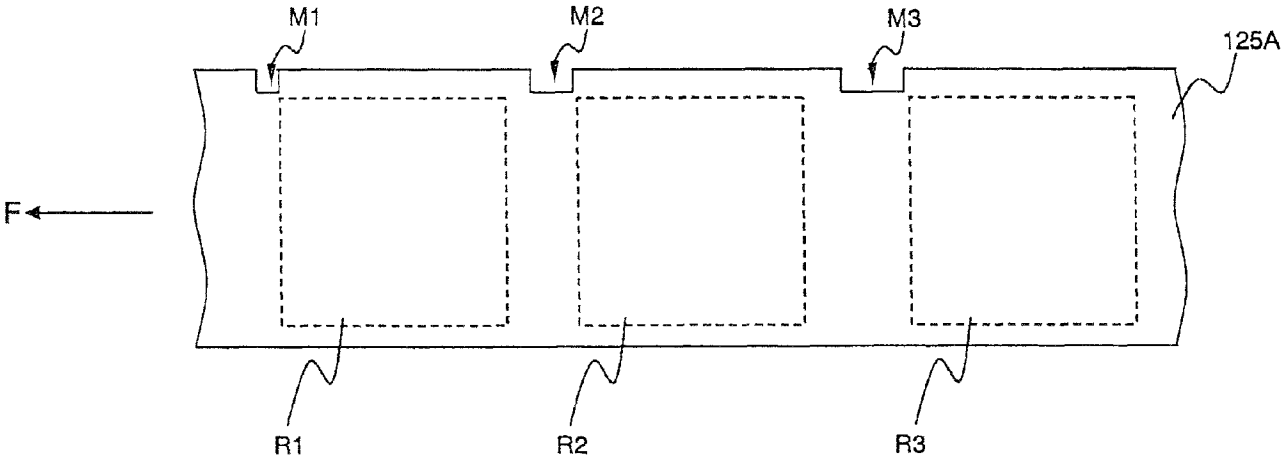
FIG. 5A is a view of a diagram illustrating an enlarged view of a portion of an intermediate transfer belt in the image forming apparatus.
Figure 5B:
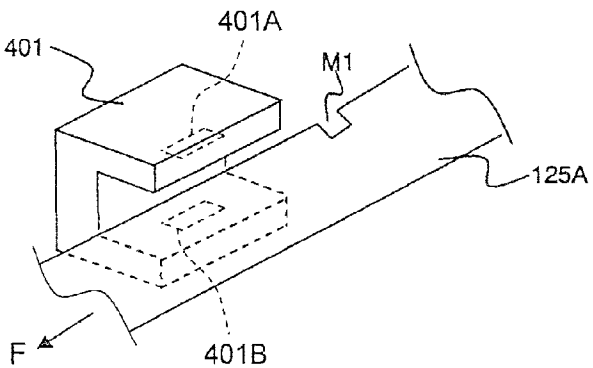
FIG. 5B is a view of a diagram illustrating a perspective view of a photointerrupter.

Selection and switching of a transfer area by the image forming apparatus 100 will be hereinafter specifically explained with reference to FIGS. 4 and 5. FIG. 4 is a view of a diagram illustrating the transfer part 125 and its peripheral elements in the image forming apparatus 100. FIG. 5A illustrates an enlarged portion of the intermediate transfer belt 125A. FIG. 5B illustrates a perspective view of a photointerrupter (PI) 401 (which is an example of a detector). Note that Arrow F illustrates a moving (i.e., circulation) direction of the intermediate transfer belt 125A.

As illustrated in FIG. 4, three marks M1, M2, and M3 are provided on the intermediate transfer belt 125A. The marks M1, M2, and M3 are sequentially arranged in the direction of Arrow F.

As illustrated in FIG. 4, the PI 401 is connected to a control unit 400. The control unit 400 is realized when the CPU 301 executes a program. The control unit 400 (which is an example of a transfer area change part) includes a switching or switch part 402, a print counter 403, a dot counter 404, a light source control part 405 (which is an example of an area selection part and drawing control part), a first timer 406, a second timer 407, and the like. The light source control part 405 is connected to the PI 401 and the laser light source 123.

As illustrated in FIG. 5A, the marks M1 to M3 are provided on the edge of the intermediate transfer belt 125A. In the present embodiment, the marks M1 to M3 are cutouts formed on the edge of the intermediate transfer belt 125A. Length of the marks M1 to M3 are different from each other in the direction of Arrow F. Also, areas R1, R2, and R3 are respectively defined between the marks M1 and M2, between the marks M2 and M3, and between the marks M3 and M1. Here, the areas R1 to R3 are respectively arranged immediately after the marks M1 to M3 in the opposite direction from Arrow F. Furthermore, the PI 401 is disposed in the vicinity of the intermediate transfer belt 125A.

As illustrated in FIG. 5B, the PI 401 includes a light source 401A and a light receiver 401B. The light receiver 401B is opposed to the light source 401A. The PI 401 is disposed to pass the intermediate transfer belt 125A between the light source 401A and the light receiver 401B.

With the configuration, the PI 401 does not transmit a detection signal when the intermediate transfer belt 125A blocks the light path from the light source 401A to the light receiver 401B. When the light path passes through the marks M1 to M3, the light path is not blocked by the intermediate transfer belt 125A. In other words, the light from the light source 401A is received by the light receiver 401B. Accordingly, the PI 401 transmits a detection signal to the light source control part 405.

The function of elements of the control unit 400 will be hereinafter explained.

The switching part 402 is configured to use one of the marks M1 to M3 as a criteria mark. Also, as described below, the switching part 402 is configured to switch the criteria mark among the marks M1 to M3. Specifically, the switching part 402 is configured to change a period of time to be counted by the first timer 406 depending on one of the marks M1 to M3 used as the criteria mark.

As described above, length of the marks M1 to M3 are different from each other in the direction of Arrow F. With the configuration, a period of time when the light path of the PI 401 is not optically blocked, that is, a period of time when the detection signal is turned on, will be different depending on which mark is used as the criteria mark.

For example, the length of the marks M1 to M3 are set to be 5 mm, 10 mm, and 15 mm, respectively. When a period of time for a detection signal corresponding to the mark M1 is N seconds, that corresponding to the mark M2 is 2N seconds (i.e., twice the period corresponding to the mark M1). Furthermore, a period of time for a detection signal corresponding to the mark M3 is 3N seconds (i.e., triple the period corresponding to the mark M1). In response to this, when the mark M1 is used as the criteria mark, the switching part 402 is configured to set a period of time to be counted by the first timer 406 to be N seconds. Similarly, when the mark M2 (or M3) is used as the criteria mark, the switching part 402 is configured to set a period of time to be counted by the first time 406 to be 2N (or 3N) seconds.

The light source control part 405 is configured to specify which of the marks M1 to M3 is currently detected by the PI 401 by measuring a period of time of the detection signal from the PI 401.

Also, the light source control part 405 is configured to regulate a position of the electrostatic latent image on the photosensitive drum 121 by regulating the irradiation timing of the laser light source 123. In other words, the light source control part 405 is configured to control the irradiation timing of the laser light source 123 so as to form an electrostatic latent image in a position that a toner image formed based on the electrostatic latent image is transferred onto a transfer area on the intermediate transfer belt 125A corresponding to the criteria mark set by the switching part 402.

For example, when the mark M1 is used as the criteria mark, a position of the electrostatic latent image on the photosensitive drum 121 is regulated to transfer the toner image onto the area R1 (see the FIG. 5A) arranged immediately after the mark M1 on the intermediate transfer belt 125A. Similarly, when the mark M2 (or M3) is used as the criteria mark, a position of the electrostatic latent image on the photosensitive drum 121 is regulated to transfer the toner image onto the area R2 (or R3) arranged immediately after the mark M2 (or M3) on the intermediate transfer belt 125A.

Processing by the light source control part 405 will be hereinafter specifically explained with reference to a flowchart illustrated in FIG. 6.

Figure 6:
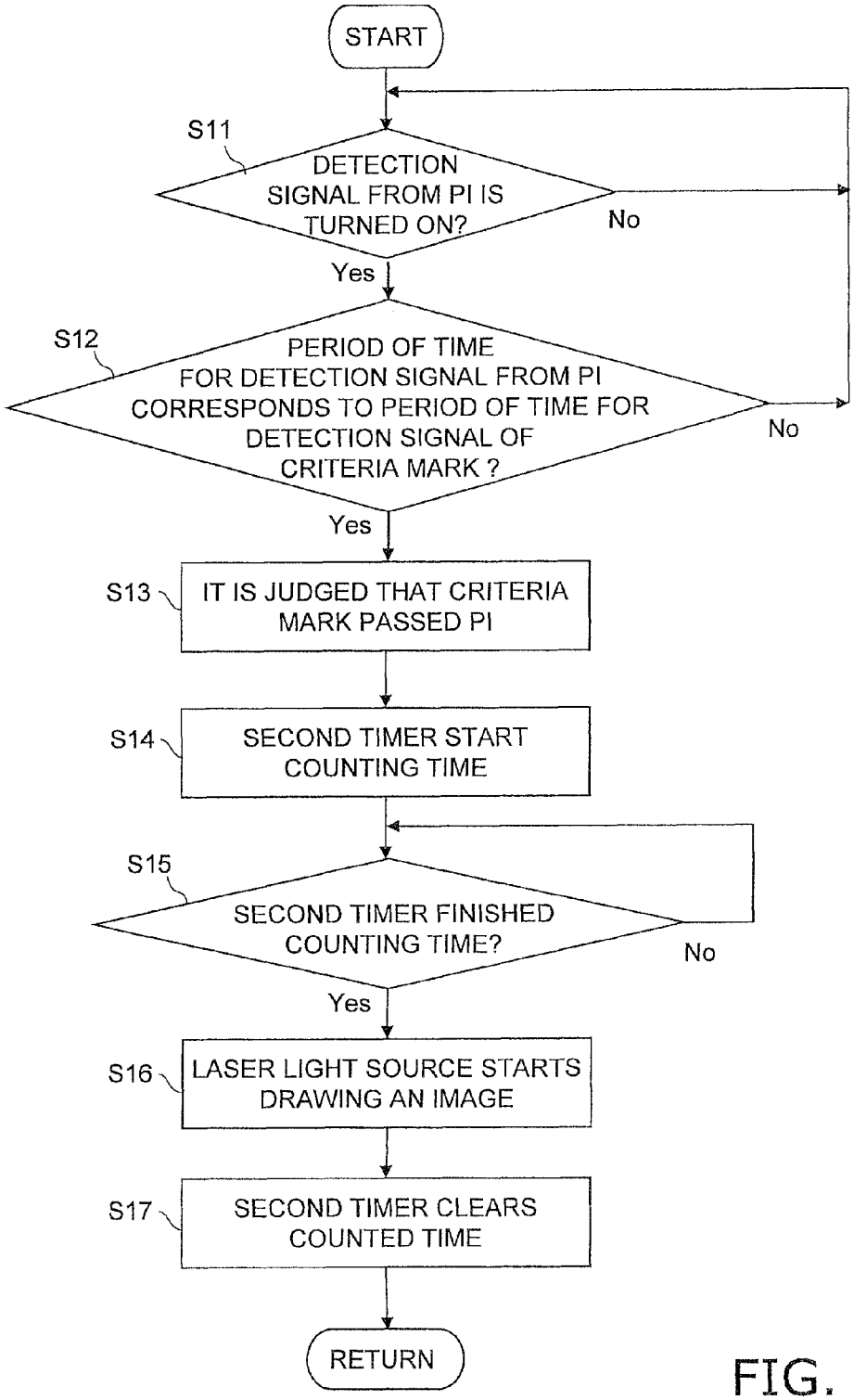
FIG. 6 is a view of a flowchart showing processing by a light source control part of the image forming apparatus.

As illustrated in FIG. 6, when a period of time of the detection signal corresponding to any one of the marks M1 to M3 used as the criteria mark by the switching part 402 is matched with a period of time of the detection signal to be actually transmitted from the PI 401 to the light source control part 405, it is possible to judge that the criteria mark passed through the PI 401 (Steps S11 to S13). Specifically, the light source control part 401 causes the first timer 406 to start counting when the detection signal from the PI 401 is turned on. Then, if a period of time counted by the first timer 406 is zero when the detection signal is turned off, it is possible to judge that the criteria mark was detected by the PI 401 (Yes in Step S12).

For example, even if the mark M2 passes through the PI 401 while the mark M1 is used as the criteria mark, a period of time for the detection signal actually counted by the first timer 406 (i.e., a period of time for the detection signal corresponding to the mark M2) is not matched with a period of time for the detection signal corresponding to the mark M1 used as the criteria mark. Accordingly, judgment in Step S12 will be "No".

When it was judged that the criteria mark passed through the PI 401, the light source control part 405 causes the second timer 407 to start counting time (Step S14). When the second timer 407 finished counting time, the light source control part 405 causes the laser light source 123 to start drawing an image (Yes in Step S15 and S16) and causes the second timer 407 to clear the counted time (Step S17).

The period of time to be counted by the second timer 407 is set to move the toner image (to be formed by developing the electrostatic latent image started being drawn in Step S16) to the primary transfer position in conjunction with rotation of the photosensitive drum 121 when the area corresponding to the criteria mark reaches the first primary transfer position (i.e., the position of the primary transfer roller 125B).

For example, the following case is herein assumed. The mark M1 is used as the criteria mark, and a period of time elapsed when the area R1 is moved to the primary transfer position after the mark M1 passed through the PI 401 is "h" seconds. Also, a period of time elapsed when the toner image is moved to the primary transfer position after the laser light source 123 started drawing the electrostatic latent image is "i" seconds. Here, the second timer 407 is configured to count (h-i) seconds. With the configuration of the second timer 407, the toner image is transferred onto the area R1.

The above-mentioned processing is executed for each of the color images. Thus, toner images corresponding to colors stored in the developing units 124Y, 124M, 124C, and 124K are accurately overlapped on the intermediate transfer belt 125A. As a result, a favorable full-color image is formed. In other words, the light source control part 405 controls the drawing timing of the laser light source 123 based on a signal from the PI 401 for the purpose of transferring the toner images of the colors on the same position (i.e., the same area) of the intermediate transfer belt 125A.

In the present embodiment, distance between the mark M1 and the area R1, distance between the mark M2 and the area R2, distance between the mark M3 and the area R3 are the same. Therefore, even if any of the marks M1 to M3 is used as the criteria mark, a period of time to be counted by the second timer 407 may be set to be the same.

However, when distance between a mark and an area corresponding to the mark depends on a mark to be used as the criteria mark, a period of time elapsed when the area corresponding to the mark is positioned on the primary transfer position after the mark passed through the PI 401 will depend on the mark to be used as the criteria mark. In this case, a period of time to be counted by the second timer 407 will be changed depending on the mark to be used as the criteria mark.

Next, switching of the criteria mark by the switching part 402 will be hereinafter explained.

The switching part 402 is configured to change the criteria mark every time a predetermined period of time has elapsed. With the configuration, the switching part 402 is configured to prevent concentration of grime on a specific portion of the intermediate transfer belt 125A by switching a position on the intermediate transfer belt 125A that the toner image is transferred.

The above-mentioned "predetermined period of time" (i.e., switching timing), is not particularly limited and may be suitably set in accordance with performance of the image forming apparatus and the like. Also, "the predetermined period of time" may be constant or variable.

The switching timing will be hereinafter exemplified.

Example 1

The Number of Printings

The print counter 403 is configured to count the number of printed-out sheets of paper (i.e., the number of printings). The switching part 402 may switch the criteria mark (e.g., from the mark M1 to the mark M2 or from the mark M2 to the mark M3) every time the number counted by the print counter 403 reaches a predetermined value (i.e., every time a predetermined number of paper is printed out).

For example, the predetermined number is determined as follows.

Referring to FIG. 3, when the CPU 301 is configured to cause a cleaning part (not illustrated in the figure) to clean the intermediate transfer belt 125A based on a cleaning program stored in the ROM 303 every time 100 sheets of paper are printed out, the predetermined number may be set to be 100. When the predetermined number is thus set, switching of a transfer area is performed every time the cleaning operation is performed. In short, the cleaning operation is considered to be a juncture to switch a transfer area. Accordingly, three areas R1 to R3 are equally used while the cleaning operation is performed three times.

Referring to FIGS. 4 and 5A, also, if the lifespan of the intermediate transfer belt 125A ends when 15,000 sheets of paper are printed out, the predetermined number may be set to be 5000 (i.e., one-third of 15,000). With the configuration of the predetermined number, three areas R1, R2, and R3 are equally used within the lifespan of the intermediate transfer belt 125A.

The image forming apparatus 100 may be provided with a setting part to set the predetermined number based on a user's instruction received through an operation panel (not illustrated in the figure). In this case, a user may input a number unrelated to the cleaning and the lifespan of the intermediate transfer belt 125A as the predetermined number. When the predetermined number is thus set, it is possible to set flexibly the predetermined number in accordance with usage of the image forming apparatus 100. For example, it is possible to change the predetermined number between a case of performing a great deal of printing with respect to a document of low printing rate and a case of performing a great deal of printing with respect to a picture of high printing rate.

Example 2

The Number of Printing Dots

Referring to FIGS. 4 and 5, the dot counter 404 is configured to count the number of printing dots. For example, the switching part 402 may be configured to switch the criteria mark (e.g., from the mark M1 to the mark M2, or from the mark M2 to the mark M3) every time the number counted by the dot counter 404 reaches a predetermined value (i.e., every time the predetermined number of printing dots is printed).

In general, as the number of printing dots is increased, grime and damage of the intermediate transfer belt 125A is accordingly increased. According to the example, it is possible to disperse grime and damage effectively and equally in three areas R1 to R3.

When resolution of the image forming apparatus 100 is 600 dpi and average printing rate is 4%, 140 million printing dots correspond to printing for 100 sheets of paper of A4 size. Here, when the predetermined number of printing dots is set to be 140 million, it is possible to switch the criteria mark at the timing approximate to the above-mentioned example 1 that the predetermined number is set to be 100.

Obviously, examples 1 and 2 may be combined. Specifically, the switching part 402 may be configured to switch the criteria mark when either the predetermined number of sheets of paper is printed out or the predetermined number of printing dots is printed.

Even if the criteria mark is switched at either of the above-mentioned timings, the switching part 402 switches among the areas R1, R2, and R3 on the intermediate transfer belt 125A as a position that the toner image is transferred. Therefore, grime is not concentrated on a specific portion of the intermediate transfer belt 125A. As a result, lifespan of the intermediate transfer belt 125A will be prolonged.

As described above, the control unit 400 functions as a transfer area change part to change a transfer area on the intermediate transfer part. Here, "changing a transfer area" may be "changing a position of the toner image on the intermediate transfer part."

Examples of Other Embodiments 2-1. The photosensitive drum 121 is only an example of an image carrier to carry a visible image (i.e., toner image). For example, the image carrier may be formed in a belt shape or the like.

2-2. The intermediate transfer belt 125A is only an example of an intermediate transfer part. The intermediate transfer part may be formed in a drum shape or the like.

2-3. As described above, the light source control part 405 is configured to regulate a transfer position of the toner image on the intermediate transfer belt 125A by regulating the timing that the laser light source 123 starts drawing the electrostatic latent image. In other words, the light source control part 405 is only an example of an area selection part to select one of a plurality of areas on the intermediate transfer part as the transfer area.

Therefore, instead of the light source control part 405, it is possible to adopt suitably an element configured to control a position on the intermediate transfer belt 125A that the toner image is transferred.

2-4. The laser light source 123 and the developing device 124 function as a drawing part. However, a configuration of the drawing part is not limited to this. Any element may be suitably adopted as the drawing part as long as the element is configured to draw a visible image.

Also, the light source control part 405 functions as a drawing control part, and is configured to control the drawing timing by controlling the irradiation timing of the laser light source 123. However, a configuration of the drawing control part is not limited to this. The configuration of the drawing control pat may be suitably changed depending on the configuration of the drawing part.

2-5. The number of marks on the intermediate transfer belt (i.e., the number of transfer areas) is not limited to three. For example, it may be two or may be equal to or greater than four.

It is particularly preferable to set the position and the number of transfer areas to distribute the transfer areas on the entire intermediate transfer belt. This is because grime is not concentrated on a particular portion of the intermediate transfer belt and accordingly it is possible to use equally the entire intermediate transfer belt.

For example, it is preferable to arrange marks on the intermediate transfer belt 125A to divide equally the length of the intermediate transfer belt 125A in the direction of Arrow F. Also, it is preferable that distance between adjacent marks is set to be a value approximately the same as (in this case, equal to or greater than) the maximum image size in the direction of Arrow F (i.e., the maximum paper size).

2-6. In the first embodiment, a cutout is used as the mark to indicate the transfer area. However, it is only an example of the mark. The mark may be suitably configured as ling as it is configured to indicate a position of the transfer area. For example, the marks may be metal films disposed on the intermediate transfer belt 125A, and the length of the metal films may be different from each other.

In this case, a detector of another type may be used instead of the PI 401. For example, the detector may be an optical sensor including a light source and a light receiver, and the light source and the light receiver may be arranged on the same side of the intermediate transfer belt 125A. In this case, the light irradiated by the light source is diffusedly reflected by or absorbed in a part of the intermediate transfer belt 125A excluding the criteria mark. Accordingly, the light does not reach the light receiver. However, the light reaches the light receiver in the position of the criteria mark. Therefore, the optical sensor is configured to detect that the light passing through the criteria mark. Also, as described above, when a plurality of criteria marks have different length, the light source control part 405 is configured to distinguish the criteria marks.

2-7. According to the first embodiment, the rotary type developing device is used for the developing device 124. However, the tandem type developing device may be used for the developing device 124. The present invention may be applied to any type of image forming apparatus as log as the image forming apparatus include the intermediate transfer part.

General Interpretation

As used herein, the following directional terms "forward, rearward, above, downward, vertical, horizontal, below, and transverse" as well as any other similar directional terms refer to those directions of a device equipped with the present invention. Accordingly, these terms, as utilized to describe aspects of the present invention, should be interpreted relative to a device equipped with the present invention.

The term "configured" as used herein to describe a component, section or part of a device includes hardware and/or software that is constructed and/or programmed to carry out the desired function.

Terms that are expressed as "means-plus function" in the claims should include any structure that can be utilized to carry out the function of that part of the present invention.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts.

The terms of degree such as "substantially," "about," and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An image forming apparatus, comprising:

an image carrier being configured to carry a visible image formed with developer;

an intermediate transfer part configured to provide a plurality of areas and a plurality of marks, each of the plurality of areas being arranged in a predetermined position with respect to at least one of the marks;

a primary transfer part being configured to transfer the visible image from the image carrier to a first transfer area of the plurality of areas on the intermediate transfer part;

a secondary transfer part being configured to transfer the visible image from the intermediate transfer part to a recording medium;

a transfer area change part being configured to change the first transfer area to a second transfer area of the plurality of areas, wherein the first transfer area and the second transfer area are separated without an overlap; and a detector being configured to detect the marks, wherein the transfer area change part includes an area selection part and a switch part, the area selection part is configured to select one of the plurality of areas as the transfer area and set the position of the visible image based on a detected result by the detector, and the switch part is configured to switch the transfer area among the plurality of areas, and wherein the marks of the intermediate transfer part include at least a first mark and a second mark, and length of each of the first mark and second mark are different from each other in a moving direction of the intermediate transfer part.

2. The image forming apparatus according to claim 1, wherein the image carrier and the intermediate transfer part are configured to move in the same direction and are opposed to each other in a primary transfer position, the primary transfer part is configured to transfer the visible image in the primary transfer position, and the area selection part is configured to set a position of the visible image on the image carrier to move the visible image to the primary transfer position when the transfer area moves to the primary transfer position.

3. The image forming apparatus according to claim 1, wherein the transfer area change part is configured to change the transfer area every time a predetermined time period has elapsed.

4. The image forming apparatus according to claim 1, further comprising a drawing part being configured to draw the visible image on the image carrier, wherein the transfer area change part is configured to change drawing timing of the drawing part.

5. The image forming apparatus according to claim 1, further comprising a drawing part being configured to draw a plurality of visible images on the image carrier, the plurality of visible images having different colors, and a drawing control part being configured to control drawing timing of the drawing part based on the detected result by the detector to overlap the plurality of visible images on the transfer area.

6. The image forming apparatus according to claim 1, further comprising a print counter being configured to count the number of printings, and wherein the transfer area change part is configured to change the transfer area every time the number of printings reaches a predetermined value.

7. The image forming apparatus according to claim 1, further comprising a dot counter being configured to count the number of printing dots, wherein the transfer area change part is configured to change the transfer area every time the number of printing dots reaches a predetermined value.

8. The image forming apparatus according to claim 1, wherein the transfer area of the plurality of areas is arranged immediately after the first mark to the second mark in an opposite direction from the moving direction of the intermediate transfer part.

* * * * *